United States Patent [19]

Young

[11] Patent Number: 4,817,480

[45] Date of Patent: Apr. 4, 1989

[54] KNIFE SHARPENER

[76] Inventor: Raymond A. Young, 7570 Springhill Dr., Gladstone, Oreg. 97027

[21] Appl. No.: 83,212

[22] Filed: Aug. 10, 1987

[51] Int. Cl.[4] ..... B26D 7/12

[52] U.S. Cl. ..... 83/174.1; 51/246

[58] Field of Search ..... 83/174, 174.1; 30/138, 30/139; 51/173, 246–248

[56] References Cited

U.S. PATENT DOCUMENTS

| | | | |
|---|---|---|---|
| D. 119,645 | 3/1940 | Smoleroff . | |
| D. 197,343 | 1/1964 | Spaziante . | |
| 492,810 | 3/1893 | King . | |
| 1,098,672 | 6/1914 | Lynch . | |
| 1,272,818 | 7/1918 | Lifshitz | 30/139 |
| 1,803,364 | 5/1931 | Stephens . | |
| 1,890,506 | 12/1932 | Frank et al. | 30/138 |
| 1,907,870 | 5/1933 | Reader . | |
| 2,010,141 | 8/1935 | Cronan . | |
| 2,018,985 | 10/1935 | Walsh . | |
| 2,471,207 | 5/1949 | Freeman . | |
| 2,721,430 | 10/1955 | Green et al. | 51/248 |
| 2,743,561 | 5/1956 | Franks . | |
| 2,767,530 | 10/1956 | Paldanius | 30/138 X |
| 2,798,344 | 7/1957 | Hertel . | |
| 3,182,700 | 5/1965 | Engi | 83/174 |
| 3,882,642 | 5/1975 | Sykes . | |
| 3,958,478 | 5/1976 | Camper | 51/248 X |

FOREIGN PATENT DOCUMENTS

| | | | |
|---|---|---|---|
| 934364 | 10/1955 | Fed. Rep. of Germany | 83/174.1 |
| 462069 | 2/1951 | Italy . | |

OTHER PUBLICATIONS

Globe Slicing Machine Co., Inc., Brochure "Hos to Sharpen the Globe Knife".

*Primary Examiner*—Frank T. Yost
*Assistant Examiner*—Rinaldi Rada
*Attorney, Agent, or Firm*—Klarquist, Sparkman, Campbell, Leigh & Whinston

[57] ABSTRACT

A knife sharpener includes an abrasive cylinder and a rectangular block for sharpening the opposed portions of a knife edge. The cylinder and block are urged together to form a sharpening notch in which the knife edge is received. The knife sharpener is particularly adapted for food slicing machines. The abrasive cylinder and block are mounted within a housing that is connected to a handle by the neck. The neck may be jointed to enable the housing to be positioned relative to the housing so that a radius of the knife perpendicularly bisects the length of the sharpening notch. The parallel planar surfaces of the handle and housing are aligned for resting against the baseplate of a food slicing machine to align the sharpening notch with the plane of the knife edge. The knife sharpener can thereby be set within the carriage tray, adjusted for proper positioning, and urged forward to receive the knife edge for sharpening.

12 Claims, 2 Drawing Sheets

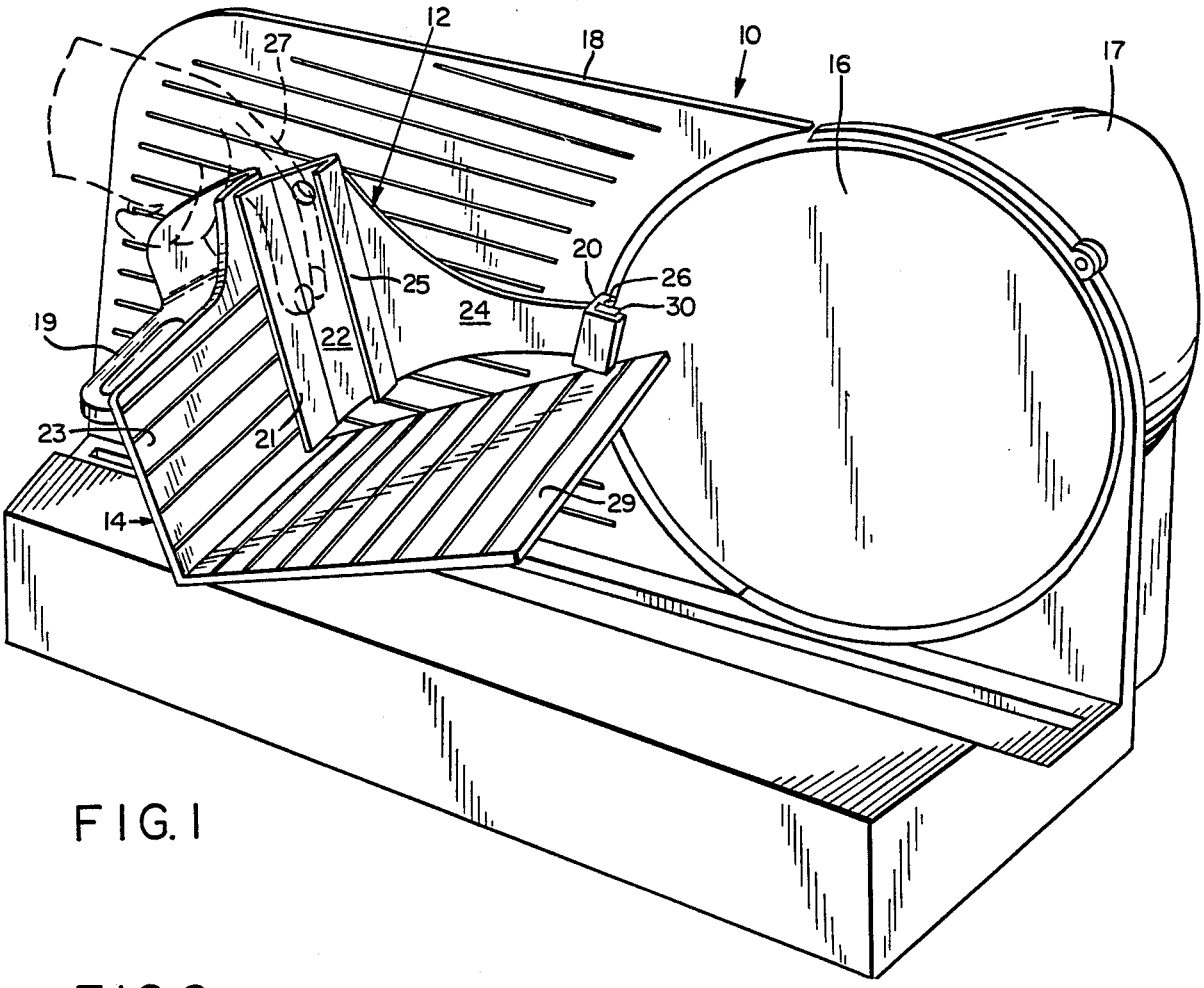
FIG. 1
FIG. 2
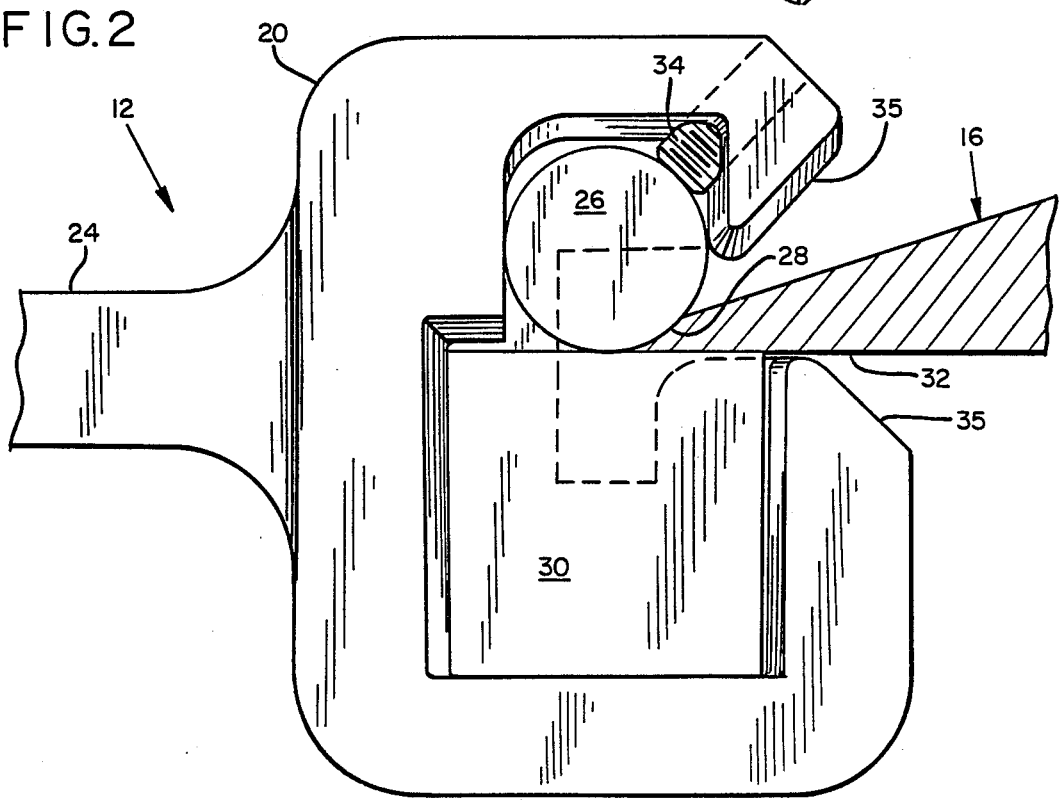

KNIFE SHARPENER

BACKGROUND OF THE INVENTION

This invention relates generally to knife sharpeners, and more particularly to a knife sharpener for sharpening a circular knife of a food slicing machine.

Powered food slicing machines are designed to slice cheeses, vegetables, and hot and cold meats quickly. The machines are commonly found in grocery stores and restaurants, where large amounts of food are prepared. The typical food slicing machine includes a circular knife rotated by an electric motor. The knife has a beveled edge portion and an opposing planar edge portion. An adjustable baseplate mounted parallel to the plane of the circular knife is movable toward and away from the knife plane to adjust the thickness of the slice. A carriage tray that holds the food to be sliced is then moved back and forth along the baseplate to enable the knife edge to slice into the food. As the knife edge engages meat, for example, the beveled portion acts to separate the slice from the rest of the meat. These food slicing machines are available from a number of manufacturers, including Hobart Corporation of Troy, Ohio; and Globe Slicing Machine Co., Inc. of Stamford, Conn.

Because of the amount of food sliced by these machines, the knife edge becomes dulled quickly and must therefore be regularly sharpened to maintain cutting efficiency. Conventional apparatus for sharpening the knife edge includes a pair of opposing powered grinding wheels that can be positioned to straddle the knife edge and grind the opposing edge portions until the edge is sharp. These sharpening apparatus, however, tend to grind the knife edge down quickly and thus shorten the life of the knife. Moreover, use of these apparatus requires considerable skill to avoid damaging the knife edge.

Prior knife sharpeners that rely on stationary sharpening elements are not suitable for grinding the circular knife of a food slicing machine. U.S. Pat. No. 1,098,672 to Lynch, for example, discloses a knife sharpener that has an abrasive surface for sharpening only the planar edge portion of the knife. But no means are disclosed for properly mounting the sharpener to sharpen the edge of a circular knife within a slicing machine.

The present invention does not have these disadvantages. It can be aligned easily with the knife edge, is inexpensive, and does not excessively grind the knife edge in sharpening it.

SUMMARY OF THE INVENTION

Therefore, an object of the invention is to provide an improved knife sharpener for sharpening knives having beveled and planar edge portions.

Another object of the invention is to provide a knife sharpener particularly adapted for food slicing machines.

Still another object of the invention is to provide such a knife sharpener that may be adjusted to fit different sized food slicing machines.

To achieve these objects, the knife sharpener according to the invention comprises first sharpening means having an abrasive convex surface for sharpening a beveled portion of a knife edge and second sharpening means having an abrasive planar surface for sharpening the opposed planar portion of the knife edge. Means are also provided for urging the convex and planar surfaces into contact to form a sharpening notch for receiving the knife edge therebetween. In the described embodiment, the first sharpening means comprises an abrasive cylinder having a circular cross section and the second sharpening means comprises an abrasive block having a rectangular cross section. The urging means comprises a housing for removably enclosing the cylinder block and an adjustable set screw within the housing for urging the cylinder and block together.

The knife sharpener may be particularly adapted for use with food slicing machines. The housing is connected to a handle by connecting means for positioning the housing relative to the handle. These connecting means may comprise a jointed neck which allows the housing to be positioned so that a radius of a knife perpendicularly bisects the sharpening notch. The jointed neck permits the knife sharpener to be used with a number of different sized food slicing machines.

The knife sharpener further includes indexing means indexed to the baseplate of a food slicing machine for aligning the sharpening notch with the plane of a knife edge. These means may comprise parallel planar surfaces of a sharpener handle and housing resting against the baseplate of the food slicing machine.

The foregoing and other objects, features, and advantages of the invention will become more apparent from the following detailed description of preferred embodiments which proceeds with reference to the accompanying drawings.

BRIEF DESCRIPTION OF THE DRAWINGS

FIG. 1 is a pictorial view showing a first embodiment of a knife sharpener according to the invention in use on a food slicing machine.

FIG. 2 is a magnified top plan view of a portion of the knife sharpener and the knife edge.

DETAILED DESCRIPTION

Figure 3:
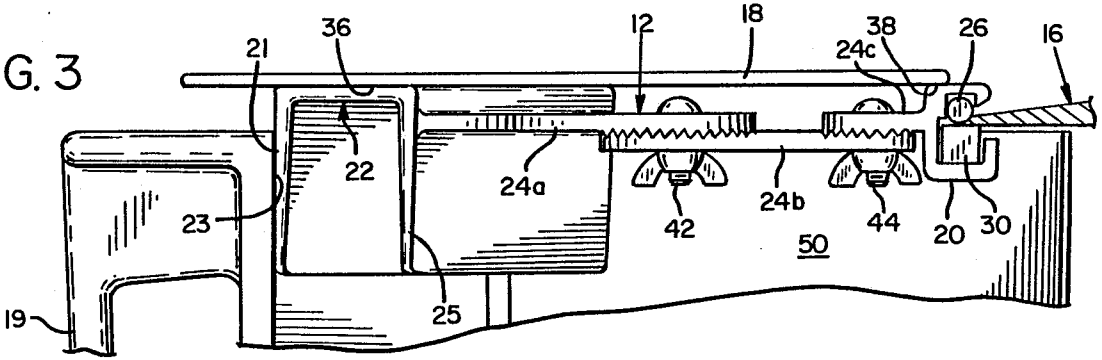
FIG. 3 is a top plan view of a second embodiment of the knife sharpener aligned with the knife edge.

Referring to FIG. 1 of the drawings, a conventional food slicing machine 10 is shown with a knife sharpener 12 according to the invention resting on the machine's movable carriage tray 14. The sharpener 12 is shown in position for sharpening a circular knife 16 rotated by a motor 17. Adjacent to the carriage tray 14 and parallel to the plane of knife 16 is a baseplate 18. The baseplate can be moved toward and away from the plane of the knife 16 by means of an adjustment knob (not shown) to select the slice thickness desired. The carriage tray 14 can be urged toward and away from the edge of knife 16 by means of a handle 19. Food is thus sliced by placing it in the carriage tray 14 against baseplate 18 and then urging the tray toward the rotating knife edge. The tray is then withdrawn, the remaining food pressed down against the baseplate, and the food is sliced again.

Figure 4:
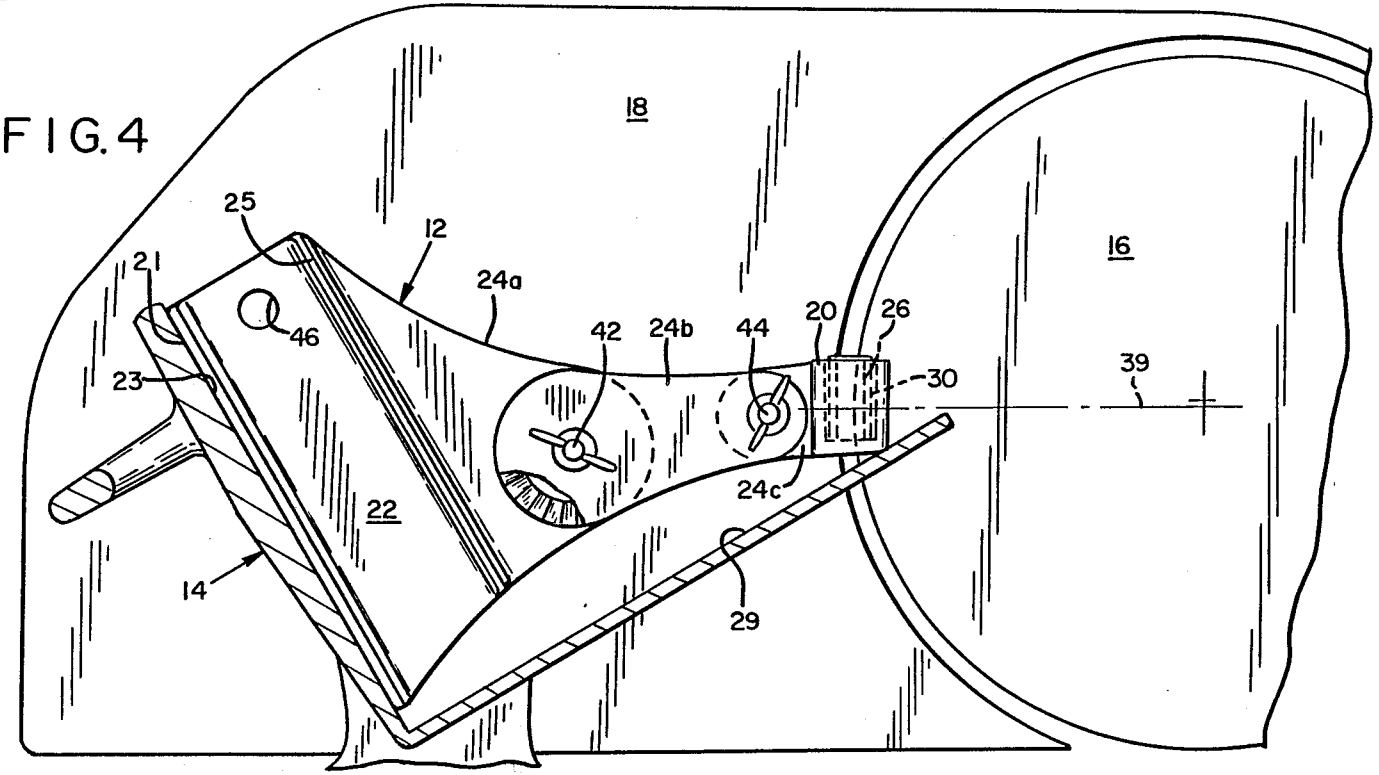
FIG. 4 is a front view of the second embodiment of the knife sharpener mounted on a food slicing machine, partly in section.

The knife sharpener 12, as shown in FIG. 1, includes a housing 20 for housing sharpening elements, to be described, a handle 22 for positioning the sharpening elements relative to the knife 16, and a neck 24 connecting the handle to the housing. The handle 22 has a base 21 adapted to lay flat against carriage tray surface 23 to position the knife sharpener properly for sharpening the edge of knife 16. The neck 24 is a unitary member in FIG. 1. The neck in FIGS. 3 and 4 is a second embodiment that is trifurcated into portions 24*a*, 24*b*, and 24*c* for adjusting the position of housing 20, as will be described. Neck 24 tapers gradually from the handle 22 to the housing 20 to provide support for the housing without excessive weight or use of material and for bracing the housing against the perpendicular tray surface 29 in sharpening the edge of knife 16. A flat shield extends parallel to the base 21 from the body of the sharpener 12 but is spaced apart from the base. The space formed between the base 21 and shield 25 is sufficient in size to allow a user to insert fingers 27 to press base 21 against surface 23 while small enough so that the shield 25 protects the fingers from sharpening debris such as flecks of metal and abrasive material.

FIG. 2 shows a magnified view of the housing 20 with a cavity open at the top but partially closed at the bottom to retain the sharpening elements while allowing the knife 16 to extend therethrough. Sized to be removably received within the housing cavity is a first sharpening means such as abrasive cylinder 26. The cylinder 26 has a convex outer surface for sharpening a beveled portion 28 of the edge of knife 16. Adjacent to the cylinder 26 is second sharpening means such as abrasive rectangular block 30. The block 30 has a planar surface for sharpening the opposing planar portion 32 of the knife edge. The convex and planar surfaces of the cylinder 26 and block 30, respectively, are stationary and urged in nonrotating physical contact by means such as adjustable Allen set screw 34 pressing against cylinder 26 within the housing cavity. The cylinder 26 and block 30 thereby form a sharpening notch for receiving the edge of the knife 16. The housing 20 is partially open opposite the sharpening notch to receive the knife through a tapered opening defined by housing edges 35. As seen in FIG. 2, the planar surface of block 30 is aligned with the planar portion 32 of the knife edge when the cylinder 26 is in contact with the beveled portion 28. This alignment assures that any burrs produced by the sharpening of the beveled portion of the knife edge are removed by honing of the planar portion with the planar surface of block 30. The cylinder 26 and block 30 are also housed relative to each other so that they intersect in a line for sharpening the knife edge uniformly within the notch.

To align properly the sharpening notch with the knife 16, the sharpener 12 is indexed to the baseplate 18. Referring to FIG. 3, such indexing is provided by alignment of planar surface 36 of the handle 22 with parallel planar surface 38 of the housing 20. The handle and housing are connected by trifurcated neck portions 24*a*, 24*b*, 24*c* and rest against the baseplate 18 to orient the sharpening notch in a plane parallel to the edge of knife 16. By adjusting the distance between the baseplate 18 and the knife plane, the sharpening notch can be aligned with the plane of the knife edge. This alignment technique eliminates binding of the knife edge in the sharpening notch while sharpening, which binding otherwise can remove a straight edge. The width of the sharpener 12 between the sharpening notch and planar surfaces 36 and 38 is chosen so that the sharpener housing 20 can fit between the baseplate 18 and knife 16 on presently manufactured foreign and domestic slicing machines 10.

The knife sharpener 12 is best stabilized on tray 14 when the knife edge contacts the sharpening notch at the center point of line between cylinder 26 and block 30. This centering also provides the maximum contact along the line between the abrasive surfaces and the knife edge. FIG. 4 shows the desired positioning of the housing 20 and its enclosed cylinder 26 and block 30 relative to the knife 16. The sharpening notch is oriented to be tangent to the knife edge, with a radius 39 of the knife 16 perpendicularly intersecting the line of the notch. Preferably the radius 39 bisects the length of the sharpening notch. Because the radius of the knife depends on the size of the machine 10, the neck 24 may be trifurcated, having two pivoting joints formed by wing nuts and bolts 42 and 44 joining neck portions 24*a*, 24*b*, 24*c*, respectively. As shown in FIG. 3, the overlapping adjacent ends of neck portions 24*a* and 24*b* have overlapping teeth extending from the bolt apertures through which bolt 42 extends. These teeth hold the joint formed between neck portions 24*a* and 24*b* in selected positions for raising and lowering the housing 20 relative to the knife 16 and handle 22. Similarly, the overlapping adjacent ends of neck portions 24*a* and 24*b* have bolt apertures through which bolt 44 extends. No teeth are required about this joint because of the relatively low torque produced by housing 20. The joint formed between neck portions 24*b* and 24*c* allows the housing 20 to be adjusted so that the sharpening notch is tangent to the knife edge when the sharpener 12 is in an operative place. The two joints together then permit the housing 20 to be positioned with the sharpening notch bisected by radius 39, as shown in FIG. 4. With the neck portions so adjusted, the base 21 of the handle 22 abuts the tray surface 23 and the lower right-hand corner of housing 20 rests on tray surface 29. These contact areas between the base 21 and tray surfaces, the planar surfaces 36, 38 and baseplate 18, and housing 20 and tray surface 29 provide stability to the knife sharpener 12 in three dimensions, enabling the user to maintain the sharpener in place with minimal effort as indicated by fingers 27 in FIG. 1.

In mounting the sharpener 12 for use, the carriage tray 14 is first withdrawn from the edge of the knife 16. The planar surfaces 36 and 38 are then pressed against the baseplate 18, and the base 21 of the handle is held against tray surface 23 to properly position the sharpener 12. The carriage tray 14 is then moved forward towards the knife 16 to gauge the position of the housing 20 relative to the knife. The housing position is adjusted by loosening wing nuts on bolts 42 and 44 and adjusting the angle of neck portions 24*b* and 24*c* appropriately as described. For operation, the tray 14 is then moved forward until the knife 16 is received in the sharpening notch. With the sharpener 12 held in place, the machine 10 is started to rotate the knife 16 and thereby sharpen it against the abrasive surfaces of the cylinder 26 and block 30. The knife rotates counterclockwise in FIG. 4 to press the sharpener 12 against tray 14, which acts to brace the sharpener against movement and thereby further stabilizes it. The shield 25 protects the hand of the operator from sharpening debris such as metal or abrasive particles. Sharpening takes but a few seconds of the knife rotation. The carriage tray 14 is then withdrawn from the knife 16 and the sharpener 12 removed.

Cylinder 26 and block 30 may be replaced when necessary by loosening screw 34 and sliding the cylinder and block out of the top of the housing cavity. The sharpener 12 also includes a hole 46 defined in the handle 22 for conveniently hanging the sharpener when not in use.

Having illustrated and described the principles of the invention in a preferred embodiment, it should be apparent to those skilled in the art that the invention can be modified in arrangement and detail without departing from such principles. For example, the trifurcated neck can be replaced with a single neck or bifurcated neck, depending on the food slicing machines to be sharpened. I claim all modifications coming within the spirit and scope of the following claims.

I claim:

1. A knife sharpener for sharpening an edge of a knife of a food slicing machine having a movable carriage tray and a baseplate, the knife edge having a beveled portion and an opposing planar portion, comprising:

first sharpening means for sharpening the beveled portion of the knife edge;

second sharpening means for sharpening the planar portion of the knife edge opposite the beveled portion;

means for urging the first and second sharpening means into contact to form a sharpening notch for receiving the knife edge therebetween; and handle means connected to the first and second sharpening means and having a base for laying against the carriage tray to position the first and second sharpening means for receiving the knife edge within the notch as the carriage tray is moved toward the knife edge.

2. The knife sharpener of claim 1 in which the first sharpening means includes an abrasive convex surface and the second sharpening means includes an abrasive planar surface positioned to be in alignment with the planar portion of the knife edge when the convex surface of the first sharpening means is in contact with the beveled portion.

3. The knife sharpener of claim 1 in which the first and second sharpening means are adapted to intersect in a line.

4. The knife sharpener of claim 1 in which the first sharpening means comprises an abrasive cylinder having a circular cross section and the second sharpening means comprises an abrasive rectangular block having a rectangular cross section.

5. The knife sharpener of claim 4 in which the urging means comprises a housing for removably enclosing the cylinder and block and an adjustable set screw within the housing for urging the cylinder and block together.

6. A knife sharpener for sharpening an edge of a knife of a food slicing machine having a movable carriage tray and a baseplate, comprising:

a first sharpening element for sharpening one portion of the knife edge;

a second sharpening element for sharpening an opposing portion of the knife edge;

housing means for urging the first and second sharpening elements into contact to form a sharpening notch for receiving the knife edge therebetween; and means indexed to the baseplate for aligning the sharpening notch with the plane of the knife edge, the knife received within the sharpening notch by movement of the carriage tray toward the knife; and handle and connecting means for positioning the housing means relative to the handle so that a radius of the knife perpendicularly bisects the sharpening notch.

7. The knife sharpener of claim 6 in which the connecting means comprises a jointed neck connecting the handle to the housing for adjusting the position of the housing relative to the knife edge.

8. The knife sharpener of claim 6 in which the handle includes a knife shield between the handle and the housing for shielding the handle from sharpening debris.

9. A knife sharpener for sharpening an edge of a knife of a food slicing machine having a movable carriage tray and a baseplate, comprising:

a first sharpening element for sharpening one portion of the knife edge;

a second sharpening element for sharpening an opposing portion of the knife edge;

housing means for urging the first and second sharpening elements into contact to form a sharpening notch for receiving the knife edge therebetween; and means indexed to the baseplate for aligning the sharpening notch with the plane of the knife edge, the indexing means comprising a handle and neck connecting the housing to the handle, the housing and handle having aligned planar surfaces for resting against the baseplate to align the sharpening notch with the plane of the knife edge, the knife received within the sharpening notch by movement of the carriage toward the knife.

10. A knife sharpener for sharpening an edge of a knife of a food slicing machine having a movable carriage tray and a baseplate, the knife having opposing beveled and planar edge portions, comprising:

a stationary abrasive cylinder for sharpening the beveled portion of the knife edge;

a stationary abrasive rectangular block for sharpening the planar portion of the knife edge;

a housing for removably receiving the block and cylinder, the housing including adjustable means for urging the block and cylinder into contact to form a sharpening notch for receiving the knife edge therebetween; and a handle and a neck connecting the housing to the handle, the handle and housing having aligned planar edges for resting against the baseplate to align the sharpening notch with the plane of the knife edge.

11. The knife sharpener of claim 10 in which the neck is jointed to allow positioning of the housing relative to the knife edge.

12. The knife sharpener of claim 1 in which the handle and first and second sharpening means are connected by a jointed neck for changing the position of first and second sharpening means relative to the knife edge.

* * * * *